United States Patent [19]

Swets et al.

[11] Patent Number: 5,069,511

[45] Date of Patent: Dec. 3, 1991

[54] PHARMACEUTICAL CABINET LOCKING ARRANGEMENT

[75] Inventors: Mark D. Swets, Grand Rapids; George A. Williams, Hudsonville; Steven F. Goodman, Wyoming, all of Mich.

[73] Assignee: Herman Miller, Inc., Zeeland, Mich.

[21] Appl. No.: 521,640

[22] Filed: May 10, 1990

[51] Int. Cl.[5] ..... A47B 87/00

[52] U.S. Cl. ..... 312/107.5; 312/216

[58] Field of Search ..... 312/107.5, 216, 217, 312/222, 215, 311

[56] References Cited

U.S. PATENT DOCUMENTS

| | | | |
|---|---|---|---|
| 549,853 | 11/1895 | Schmidt | 312/107.5 |
| 781,392 | 1/1905 | Bloomer . | |
| 1,366,451 | 1/1921 | Hawley . | |
| 1,603,483 | 10/1926 | Masengale . | |
| 1,928,265 | 9/1933 | Rand . | |
| 1,951,628 | 3/1934 | Prost . | |
| 2,309,863 | 2/1943 | North . | |
| 2,719,770 | 10/1955 | Roberts . | |
| 2,823,536 | 2/1958 | Watson . | |
| 2,903,316 | 9/1959 | Merz | 312/216 |
| 3,005,671 | 10/1961 | Majeski . | |
| 3,010,775 | 11/1961 | Giovannelli . | |
| 3,399,939 | 9/1968 | Anderson . | |
| 3,457,744 | 7/1969 | Bisbing . | |
| 3,489,479 | 1/1970 | Sulentic . | |
| 3,516,719 | 7/1970 | Weisblat . | |
| 3,565,504 | 2/1971 | Brown . | |
| 3,760,952 | 9/1973 | White . | |
| 3,860,309 | 1/1975 | Brendgord . | |
| 3,893,740 | 7/1975 | England . | |
| 3,902,603 | 9/1975 | Wilson . | |
| 4,452,498 | 6/1984 | Wood, Jr. et al. . | |
| 4,616,890 | 10/1986 | Romick . | |
| 4,629,263 | 12/1986 | Hendriks . | |

*Primary Examiner*—Kenneth J. Dorner
*Assistant Examiner*—Gerald A. Anderson
*Attorney, Agent, or Firm*—Varnum, Riddering, Schmidt & Howlett

[57] ABSTRACT

A pharmaceutical cart for retaining a plurality of dispensing bins on shelves is provided with cooperating horizontal and vertical locking bars to provide easy access to each of the individual bins and a simplified locking mechanism which prevents bins from being removed when in a locked position. The cart is equipped with a plurality of cassettes, each having a pair of spaced-apart parallel shelves, and a plurality of dispensing bins disposed side-by-side on the shelves and slidably removable from the front of the cart. The horizontally extending locking bar, which has an elongated cross section, extends frontally to the lower part of bins on the upper shelf and the upper part of bins on the lower shelf. The locking bar is pivotally attached to the walls of the cassette and may be rotated to a horizontal position for removal of individual ones of the bins. The vertical locking bar is hingedly attached to one side of the cart and in its locking position extends in front of the cassettes to prevent their removal and engages the horizontal locking bar of each of the cassettes to prevent their rotation. In this manner, operation of the vertical locking bar to its locked position locks each of the cassettes and each of the bins individually.

17 Claims, 6 Drawing Sheets

PHARMACEUTICAL CABINET LOCKING ARRANGEMENT

BACKGROUND OF THE INVENTION

1. Field of the Invention

The invention relates to pharmaceutical cabinets and particularly to lockable pharmaceutical cabinets comprising a plurality of medication bins.

2. Prior Art

Lockable pharmaceutical cabinets and carts are widely used in hospitals and other medical care facilities. Keeping pharmaceutical products secure from unauthorized access is a matter of major concern in the medical care facilities, not only to protect against theft and misuse of the pharmaceuticals but also to comply with legal requirements concerning controlled substances. Security of pharmaceutical carts used for delivering and dispensing pharmaceutical substances are of particular concern since the carts are of necessity used in areas where they are within easy reach of patients and other non-medical personnel. It is a general requirement in hospitals and the like that pharmaceutical carts be locked when not attended by an authorized person. It is therefore desirable to provide a cabinet or cart which may be readily locked and unlocked and which provides convenient storage and access for preselected pharmaceuticals to be dispensed. Pharmaceuticals to be dispensed may be contained within individual dispensing bins to be removed from the pharmaceutical cart or cabinet, one at a time. It is therefore desirable to provide an arrangement in which an individual dispensing bin may be conveniently removed and the remaining bins may be made secure in a convenient manner.

The U.S. Pat. No. 4,616,890 to J. M. Romick (issued Oct. 14, 1986) discloses a medication cart including cassettes of medication bins. Each cassette includes a plurality of stacked drawers slidably contained within a cabinet frame and a plurality of medication bins contained within each of the drawers. The several drawers of a cassette may be locked by means of a single locking bar internal to the cabinet frame and extending vertically along one side thereof. The locking bar engages each drawer individually and is operable in the vertical direction by means of a key lock.

The U.S. Pat. No. 3,893,740 to W. G. England (issued July 8, 1975) discloses a multiple drawer cabinet having a lockable vertically extending locking bar external to the cabinet and pivotally attached to one edge thereof. The locking bar, in its locked position, extends along the front of several drawers to obstruct opening movement. The U.S. Pat. No. 3,902,603 to J. D. Wilson (issued Sept. 2, 1975) discloses a similarly positioned drawer retaining bar.

A disadvantage of the arrangement disclosed in the Romick patent is that the bins for containing the substances to be dispensed are contained within drawers. When such a cart is used for dispensing pharmaceuticals, a drawer containing several bins has to be at least partially withdrawn from the cabinet frame to gain access to any one of the bins. Closing the drawer each time after removal of a bin is inconvenient, but an open drawer detracts from a secure environment. The prior art arrangement does not provide for a secure and convenient access to individual bins and makes no provision for retaining or locking individually removable bins, not contained within a drawer. Similar disadvantages obtain with respect to other known prior art arrangements.

SUMMARY OF THE INVENTION

These and other problems of the prior art are overcome in accordance with this invention in a pharmaceutical cabinet having a support shelf and a plurality of slidably removable dispensing bins supported on the shelf in a side-by-side relation, by providing cooperating first and second locking bars extending substantially in mutually perpendicular directions. The first locking bar, which has an elongated cross section is disposed frontally to the bins and is rotatable to a releasing position wherein the longer dimension of the elongated cross section extends parallel to the direction in which the bins are slidably removable from the shelf and rotatable to a locking position wherein the longer dimension extends in a direction perpendicular to the direction of sliding of the bins for restraining removal thereof. The second locking bar engages the first locking bar to prevent its rotation and to maintain the first locking bar in the locking position.

In one specific embodiment of the invention, a pharmaceutical cabinet comprises a pair of upper and lower spaced-apart substantially parallel shelves each slidably supporting a plurality of bins and the bin locking bar is disposed frontally to a lower portion of bins supported on the upper shelf and an upper portion of bins supported on the lower shelf. When rotated to the locking position, the bin locking bar restrains removal of bins from both of the shelves. In the particular embodiment, the cabinet has vertically extending sides with the shelves disposed horizontally in the cabinet and the cabinet locking bar is hingedly attached to one of the vertical sides and can be pivoted to a locking position for engagement with the bin locking bar. The cabinet locking bar is provided with a locking pin engaging the cabinet and a key lock operable to disengage the pin from the cabinet. Advantageously, in an arrangement in accordance with the present invention, a plurality of dispensing bins may be locked in place by pivoting a cabinet bar into the locked position without the need for providing individual locks on the bins or requiring that the bins be contained within a lockable drawer or the like, as taught by the prior art. Furthermore, in accordance with this invention, the bins may be readily removed by unlocking one of the cooperating locking bars, namely the cabinet locking bar, which will allow for free rotation of the bin locking bar, providing for convenient removal of the bins individually.

The pharmaceutical cabinet in accordance with the invention may be constructed as a segmented side wall cart provided with wheels for ease of transportation of the bins to desired locations. In one embodiment of the invention, the cabinet is provided with a plurality of vertically stacked cassettes, each comprising a pair of the upper and lower spaced-apart shelves and a bin locking bar for each cassette. The cabinet locking bar extends across several of the vertically stacked cassettes and acts to prevent rotation of the bin locking bar of each of the vertically stacked cassettes. Furthermore, the cassettes may be slidably inserted in the cabinet and the cabinet locking bar is disposed in front of at least a portion of each of the cassettes to prevent their sliding removal from the cabinet. Advantageously, in accordance with this invention, a single cabinet locking bar disposed frontally to a plurality of vertically stacked cassettes cooperates with horizontally extending bin locking bars of each of the cassettes to prevent removal of the cassettes and each of the individual bins disposed within the cassettes.

In one embodiment of the bins in accordance with this invention, each bin is provided with a front handle comprising a frontal piece and a pair of spaced-apart connecting walls connecting the frontal piece to the bin and each of the side walls is provided with an arcuate upper and lower section having a radius of a dimension sufficient to allow rotation of the bin locking bar disposed frontally to the bins. The bin locking bar, in one embodiment, is provided with a pivot pin offset from the geometric centerline of the bar to provide a gravitational force for urging rotation of the locking bar to the locking position. Advantageously, locking of the cabinet is made easier when the horizontally extending bin locking bars are in a locking position prior to engagement with the vertically extending cabinet locking bar.

BRIEF DESCRIPTION OF THE DRAWING

The invention is described with reference to the drawing, in which.

DETAILED DESCRIPTION

Figure 1:
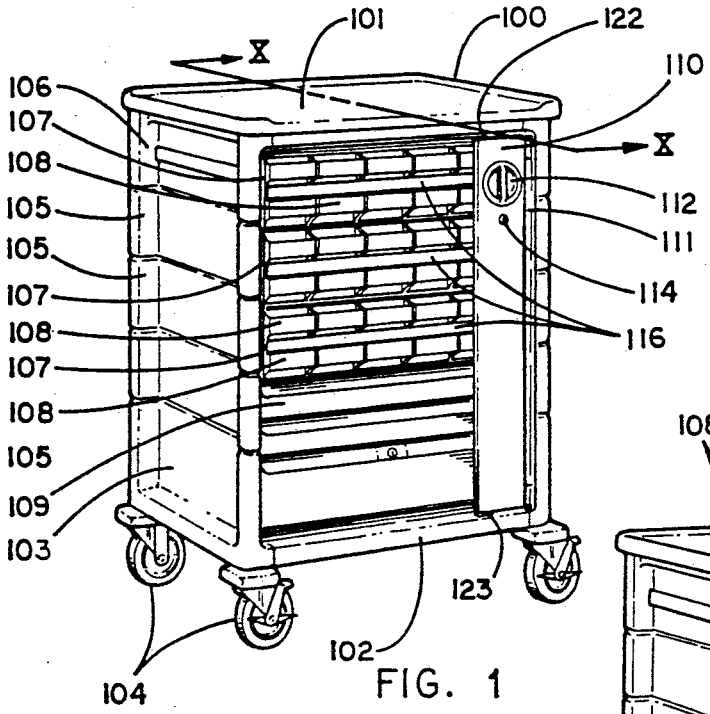
FIG. 1 is a perspective view of a pharmaceutical cart embodying the principles of the invention, shown in the locked condition.
Figure 2:
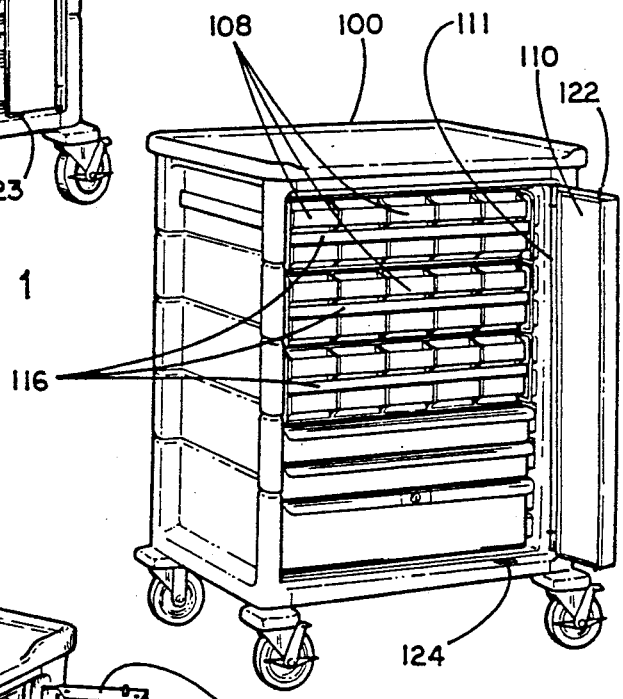
FIG. 2 is a perspective view of the pharmaceutical cart of FIG. 1, shown in the unlocked condition.

Referring to FIGS. 1 and 2, an illustrative embodiment of the invention comprises a segmented side wall pharmaceutical cabinet 100 having a housing comprising a top surface 101 and a base 102. The cabinet is provided with casters 104 and may be used as a pharmaceutical dispensing cart. The cabinet housing further comprises a base side wall segment 103, middle side wall segments 105 and a top segment 106. It is provided with a plurality of drawers 109 for containing various items and a plurality of pharmaceutical cassettes 107, each containing a plurality of bins 108. Each of the cassettes 107 comprises two rows of bins 108 disposed in a side-by-side relation, and is slidably removable from cabinet 100. Each of the cassettes 107 is further provided with a horizontally extending bin locking bar 116 extending frontally along a lower portion of an upper row of bins and a upper portion of a lower row of bins. The bin locking bar has an elongated cross section and is rotatable between a horizontal releasing position allowing for removal of individual ones of the bins 108 and a vertical locking position in which removal of the bins is restrained. A vertically extending cabinet locking bar 110 is hingedly attached to one side of cabinet 100 by means of hinge 111 and is rotatable between a locked position as shown in FIG. 1 and an unlocked position as shown in FIG. 2. When in the locked position, as shown in FIG. 1, cabinet locking bar 110 cooperates with the horizontally extending bin locking bars 116 of the individual cassettes 107, to lock each of the individual bins 108 in the cart. When in the locked position, the cabinet locking bar 110 engages each of bin locking bars 116 to prevent their rotation to a releasing position. The vertical locking bar 110 is provided with an upper locking pin 122 extending from a top edge of locking bar 110 and engaging an upper part of cabinet 100 and a lower locking pin 123 extending from a bottom edge of bar 110 and engaging a lower part of cabinet 100. A rotatable handle 112 is provided to operate locking pins 122, 123 to the unlocked position for opening vertical bar 110. A key lock 114 prevents rotation of the handle 112 unless operated by a key.

Figure 3:
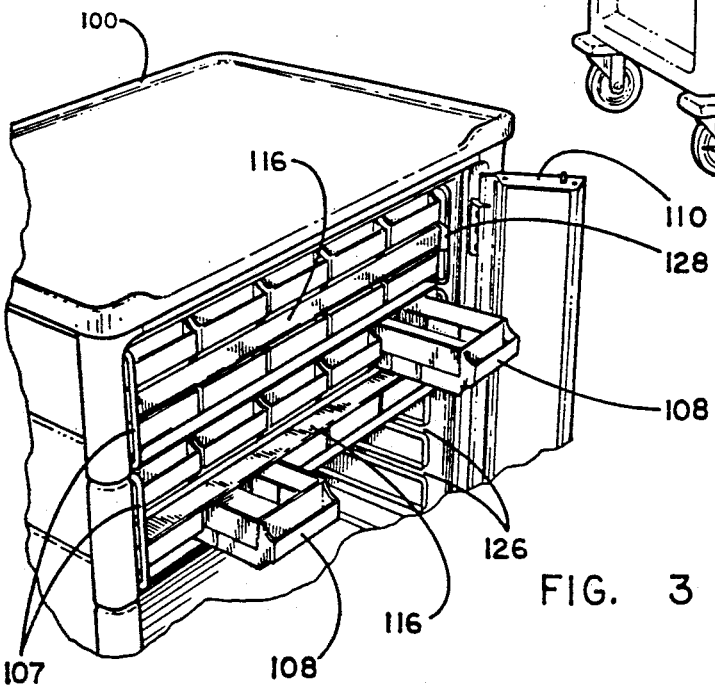
FIG. 3 is an enlarged fragmentary perspective view of the cart of FIGS. 1 and 2, showing greater detail.

FIG. 3 is an enlarged fragmented view of a top portion of cabinet 100 showing channels 126 for slidably engaging cassettes, such as cassettes 107. FIG. 3 shows two of the bins 108 of the lower of the two cassettes 107 in a partially withdrawn position. With cabinet locking bar 110 in the open position, as shown in FIG. 3, the bin locking bars 116 are allowed to rotate on pivot supports, such as pivot support 128. Withdrawal of any of the bins causes the corresponding bin locking bar to be rotated from a vertical orientation to a horizontal orientation, as reflected by the lower of the two bin locking bars 116 shown in FIG. 3. It will be readily apparent that none of the side-by-side bins can be removed when the corresponding bin locking bar is restrained from being rotated to the horizontal orientation by cabinet locking bar 110.

Figure 4:
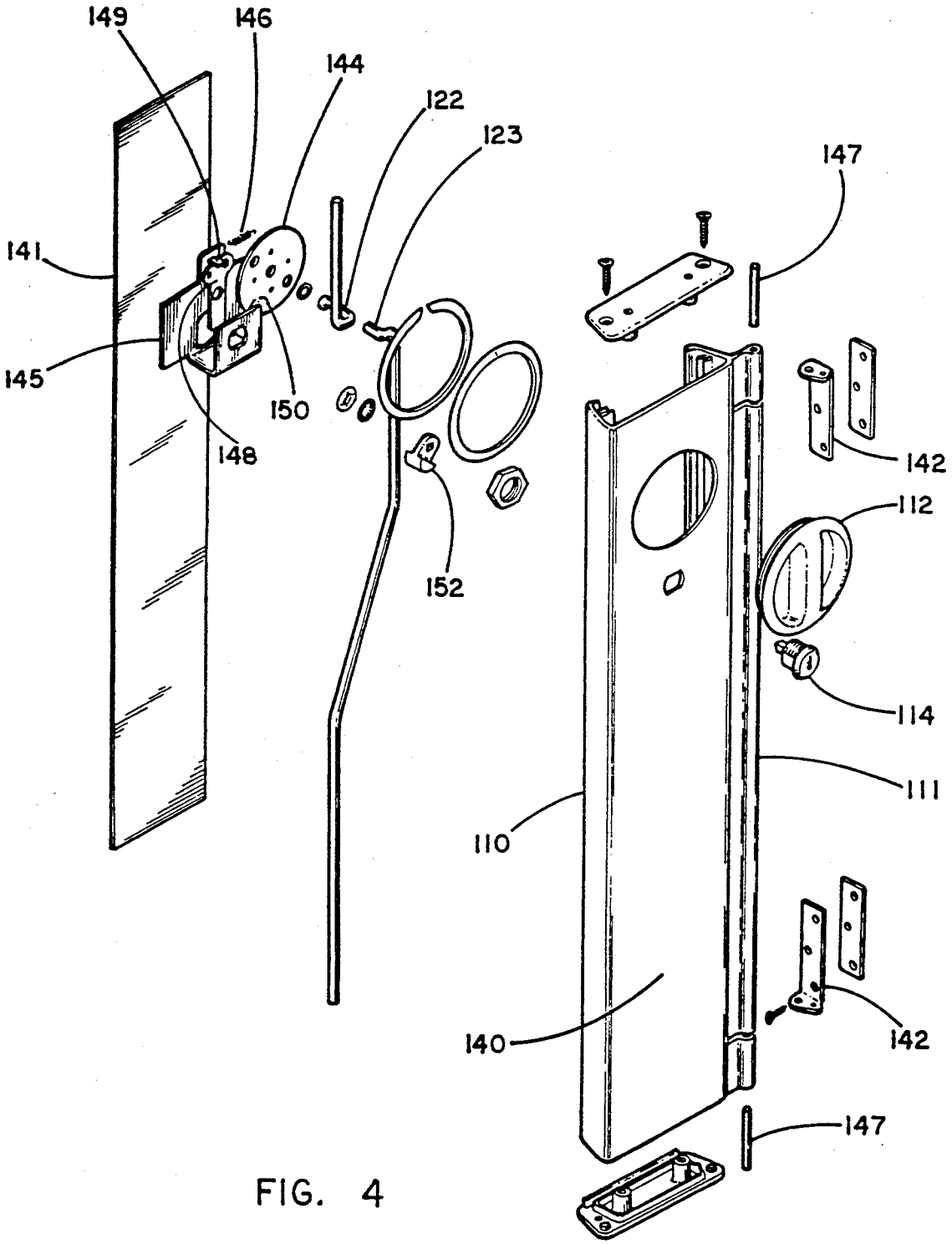
FIG. 4 is an exploded view of a key lock locking bar of the cart of FIG. 1.
Figure 5:
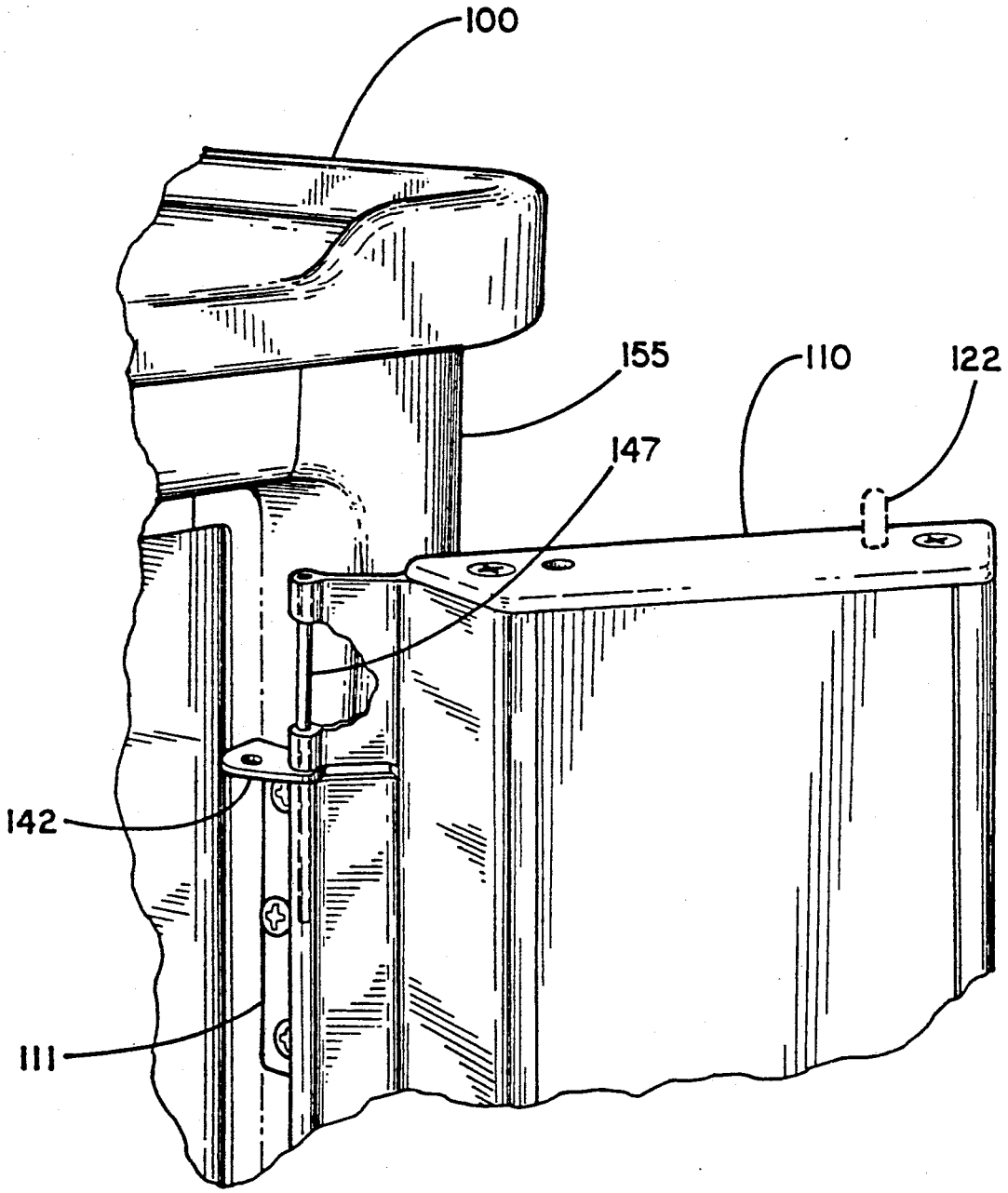
FIG. 5 is a more detailed view of the arrangement for attaching the key lock locking bar.

FIG. 4 is an exploded view of cabinet locking bar 110 showing details of the latching mechanism for engaging upper and lower portions of cabinet 100. The cabinet locking bar 110, which comprises a front panel 140 and a back panel 141 is attached to one side of cabinet 100 by means of brackets 142 engaging pins 147 of hinge 111. The latching mechanism of FIG. 4 includes upper and lower locking pins 122, 123 which engage a disk 144, which in turn engages rotatable handle 112. A latch arm 148 rotatably mounted on latch bracket 145, and provided with a latch tab 149, is urged against disk 144 by means of spring 146. The latching mechanism is shown in FIG. 4 in the unlocked position. Rotation of disk 144 in the clockwise direction, by means of handle 112, causes upper and lower locking pins 122, 123 to be extended for engagement with cabinet 100. As disk 144 is rotated in the clockwise direction, tab 149, being urged against disk 144 by spring 146, will engage slot 150 in disk 144, thereby latching the mechanism in the locked position. A key lock 114 is provided with a lock cam 152 for engaging latch arm 148. As key lock 114 is turned in a clockwise direction, latch arm 148 is rotated to disengage latch tab 149 from slot 150 and handle 112 may then be rotated in the counterclockwise direction to disengage upper and lower locking pins 122, 123 from housing 100. If thereafter the key lock 114 is rotated in the counterclockwise direction, cam 152 will be disengaged from latch arm 148 and spring 146 will act to urge latch tab 149 against disk 144. Consequently, the vertically extending cabinet locking bar 110 may again be locked to the cabinet by rotation of handle 112 and without the need for a key to operate key lock 114. FIG. 5 is a partially broken-away view of locking bar 110 showing engagement of pin 147 with hinge section 111 of cabinet locking bar 110 and attachment of bracket 142 to a vertical side 155 of cart 100.

Figure 6:
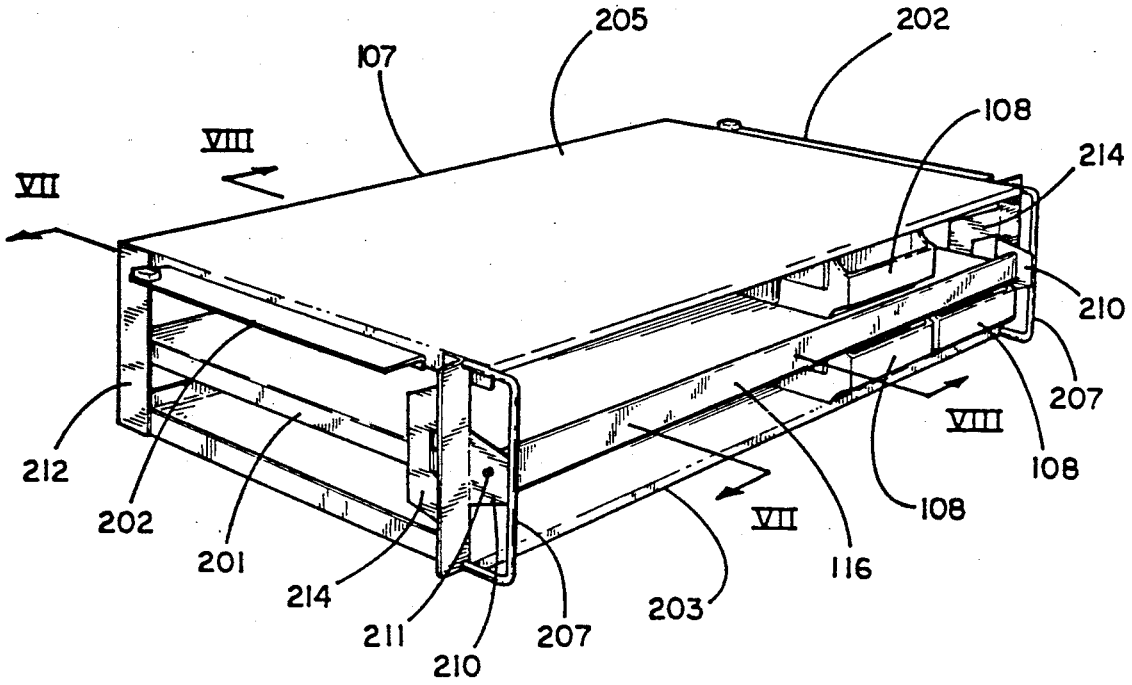
FIG. 6 is a perspective view of a partially occupied removable cassette of dispensing bins used in the cart of FIG. 1.
Figure 7:
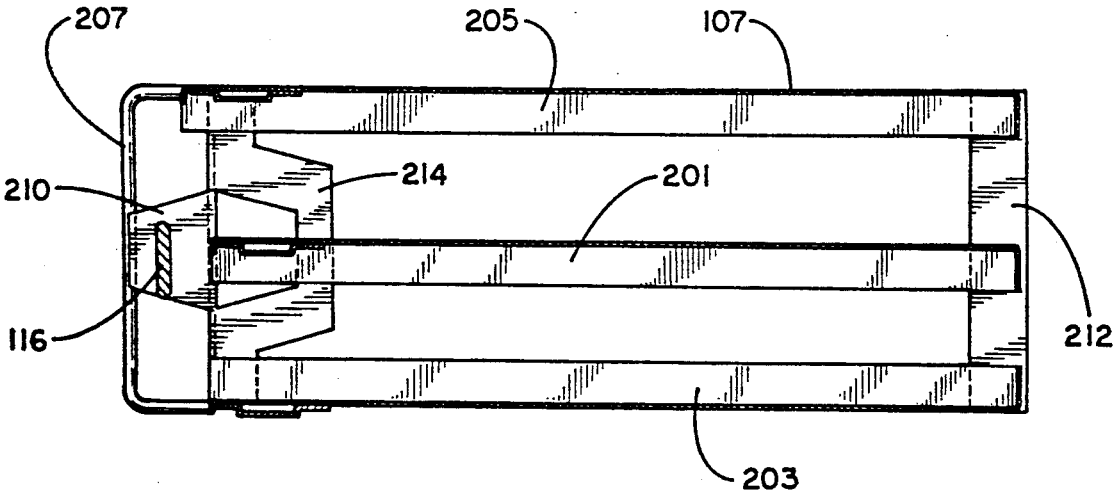
FIG. 7 is a cross-sectional view along line VII—VII of FIG. 6.
Figure 8:
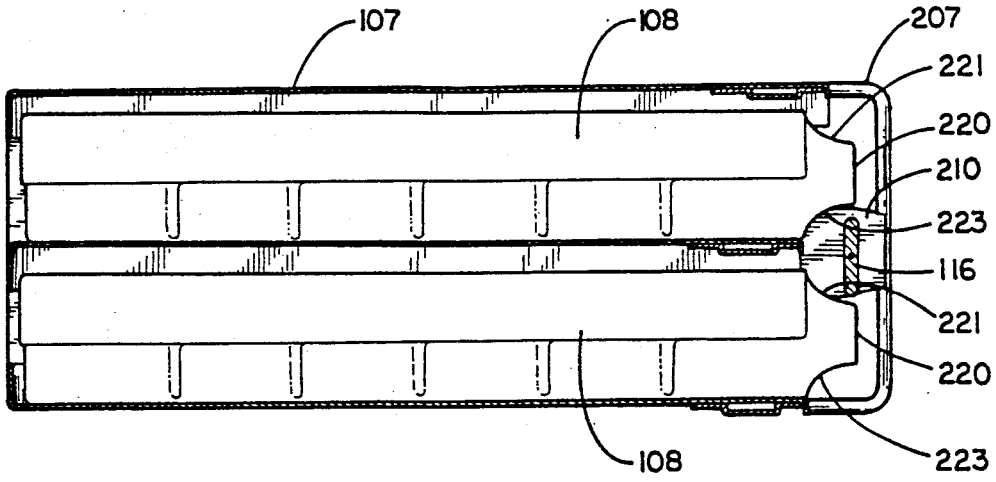
FIG. 8 is a cross-sectional view along line VIII—VIII of FIG. 6.
Figure 9:
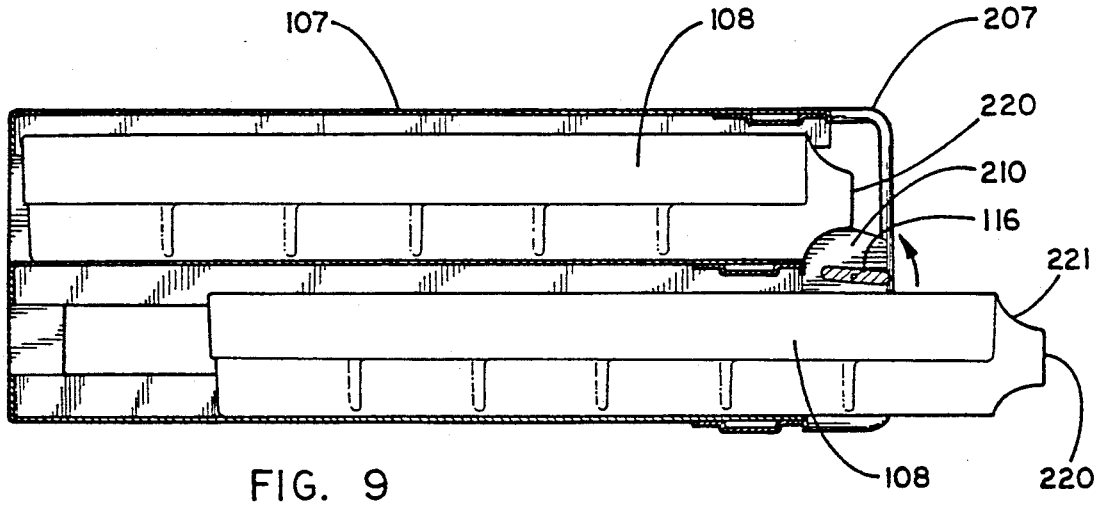
FIG. 9 is a modified cross-sectional view along line VIII—VIII of FIG. 6 showing a bin in a partially withdrawn position.
Figure 13:
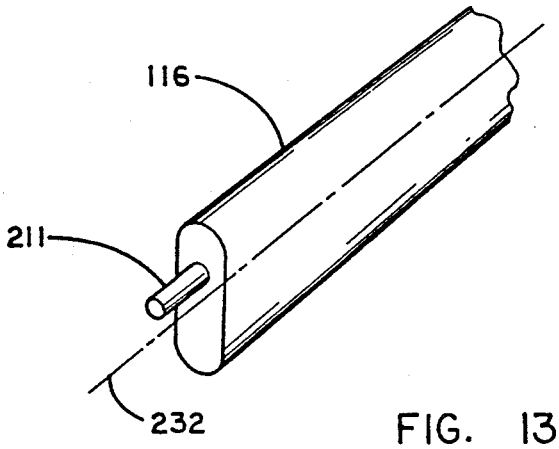
FIG. 13 is a partial perspective view of a bin locking bar used in the cart of FIG. 1.

FIG. 6 is a perspective view of one of the cassettes 107 of FIG. 1. The cassette comprises a pair of spaced-apart parallel shelves 201, 203 for supporting bins 108, and a top surface 205. Shelves 201, 203 and top surface 205 are spaced apart by a sufficient distance to accommodate bins 108 while preventing external access to the top opening of the bins. Shelves 201, 203 and top 205 are supported by means of back corner brackets 212 and front brackets 214. Handles 207 are provided for ease of insertion and removal of the cassettes in the cabinet housing of cart 100. Side rails 202 are provided for engagement with channels 126 (FIG. 3) of cabinet 100. Front brackets 214 are provided with tabs 210 for pivotally supporting bin locking bar 116 which engages tab 210 by means of pivot pin 211. FIG. 7 is a cross section along line VII—VII of FIG. 6 showing an unoccupied portion of cassette 107 and showing bin locking bar 116 in cross section. FIG. 8 is a cross sectional view of the cassette 107 along line VIII—VIII of FIG. 6 providing a view of the right-hand occupied portion of the cassette 107 of FIG. 6. Bin locking bar 116 is shown in cross section and showing its position relative to upper and lower bins 108 when the bins are contained within the cassette 107. The bins 108 are each provided with a front handle 220 having side panels provided with upper and lower arcuate sections 221 and 223, respectively. The arcuate sections are provided to accommodate the rotational movement of bin locking bar 116 while at the same time restricting forward travel of bins when bar 116 is locked in the vertical locking position. Even though the arcuate sections are not necessary for the upper edge of the upper one of the trays 108 or the lower edge of the lower one of the trays 108, the handles of all of the trays are made identical to facilitate interchangeability of the trays. The rotatable bin locking bar 116, shown in perspective view in FIG. 13, is provided with a pivot pin 211 which is offset from the geometric centerline 232 of bar 116 in order to provide a gravitational force urging bar 116 to the essentially vertical position as depicted in FIG. 8. The amount of offset is a matter of design choice and will be selected to obtain the desired effect of having bar 116 automatically return to the vertical position. This facilitates locking of the cabinet by movement of vertically extending cabinet locking bar 110 to its locking position. FIG. 9 is a cross-sectional view of the cassette 107 of FIG. 6 along line VIII—VIII except that one of the trays 108 is shown partially withdrawn from cassette 107. Bin locking bar 116 is shown in cross section in FIG. 9 and in a more nearly horizontal position to allow withdrawal of the lower one of the bins 108. The arrow in FIG. 9 indicates a rotation of bar 116 in the counterclockwise direction by engagement of arcuate section 221 of the lower bin 108, when the bin is withdrawn.

Figure 10:
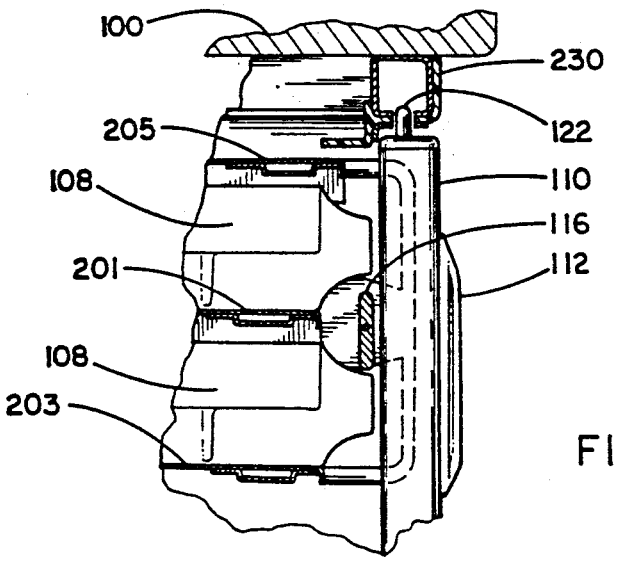
FIG. 10 is a cross-sectional view along line X—X of FIG. 1.

FIG. 10 is a partial sectional view of cabinet 110 along line X—X of FIG. 1. FIG. 10 shows the vertically extending cabinet locking bar 110 in its locking position with upper pin 122 engaging a structural member 230 of cabinet 100. Bin locking bar 116 is shown in cross section in the vertical or locking position. As will be apparent from the drawing, any attempt to remove one of the bins 108 from the cabinet housing 100, which requires rotation of bin locking bar 116 to the position indicated generally in FIG. 9, will be prevented by engagement of bin locking bar 116 with cabinet locking bar 110. Cabinet locking bar 110 similarly engages bin locking bars 116 of other cassettes 117 in cabinet 100, and in this manner cooperates with a plurality of bin locking bars 116 to prevent removal of any of the bins from any position within the cabinet. As is evident from the drawing, cabinet locking bar 110, when in its locking position, obstructs withdrawal of an entire cassette 107 as well as preventing withdrawal of the individual bins.

Figure 11:
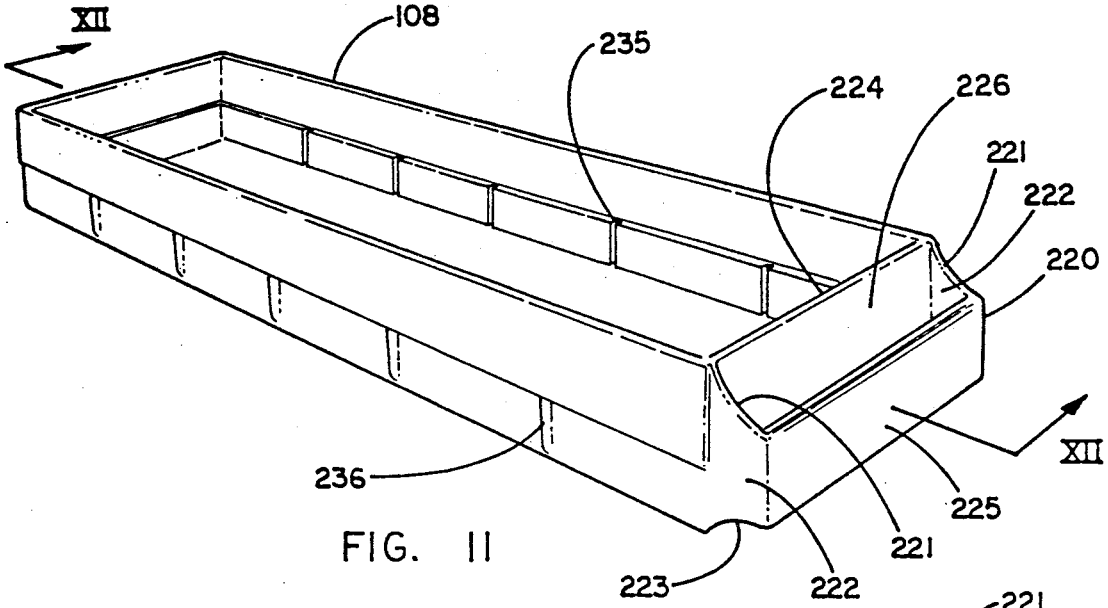
FIG. 11 is a perspective view of a bin for use in the cart of FIG. 1.
Figure 12:
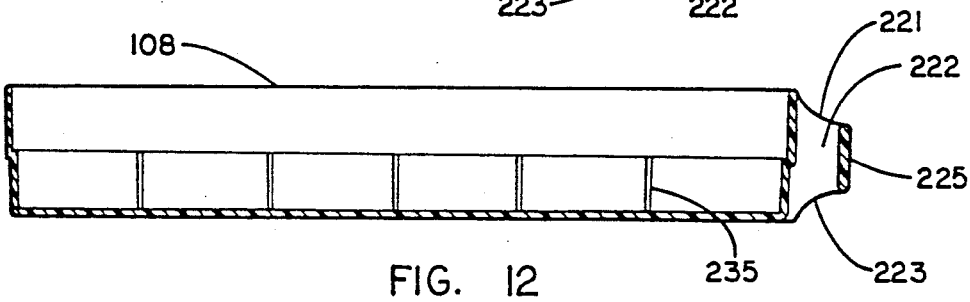
FIG. 12 is a cross-sectional view along line XII—XII of FIG. 11.

Referring to FIG. 11 and FIG. 12, which is a cross-sectional view along line XII—XII of FIG. 11, there is shown one of the bins 108 provided with a plurality of vertically extending slots 235 for receiving divider plates for providing a number of compartments within bin 108. External ribs 236 are provided at positions corresponding to slots 235. Handle 220 comprises frontal wall 225 and a pair of side walls 222 extending in a direction substantially perpendicular to frontal wall 225. A spatial area 226 is defined by the two side walls 222, handle frontal wall 225 and frontal wall 224 of bin 108. The spatial area conveniently allows for a hand-grab of the handle 220 either from above or below frontal wall 225. Side walls 222 are each provided with top and bottom arcuate sections 221 and 223, respectively, as described earlier with respect to FIG. 8. Because the axes of rotation of bin locking bar 116 is offset from the geometric axis (FIG. 13), the space required for rotation of bar 116, as outlined by lower arcuate section 223 is smaller than the space required for rotation in the area of upper arcuate section 221. Accordingly, the arcuate sections may be dimensioned differently to accommodate rotation of bar 116.

While the invention has been described with particular reference to the vertically extending cabinet locking bar 110, it will be understood that other blocking members which extend vertically and frontally relative to the cassettes 107 and the bins 108 may be employed. Such blocking members can be disposed relative to the bin locking bars 116 to prevent the rotation of the bars between the locking and releasing positions. For example, the locking bar 110 can be in the form of a strap, bar, or other relatively rigid member which is secured to the top surface 101 and/or the base 102 of the cabinet 100, and which extends frontally relative to the cassettes 107 and the bins 108. Such a locking member is selectively positionable to either block rotation of the bin locking bars 116 or to allow rotation of the bars as may be desired.

It will be understood that the embodiments described herein are only illustrative of the invention and numerous other embodiments may be devised by those skilled in the art without departing from the spirit and scope of the invention.

What is claimed is:

1. A pharmaceutical cabinet comprising:

a pair of side walls in spaced-apart relationship;

a pair of upper and lower spaced-apart substantially parallel shelves mounted between and to said side walls, each of said shelves having a front edge;

a plurality of dispensing bins supported on each of said shelves in a side-by-side relation and removable by sliding said bins in a direction substantially perpendicular to said front edge; and a first locking bar mounted to said side walls and disposed frontally to a lower portion of each of said bins supported on said upper shelf and an upper portion of each of said bins supported on said lower shelf and having an elongated cross section, said first locking bar rotatable about an axis of rotation extending in a direction substantially parallel to said front edges to a releasing position wherein a longer dimension of said elongated cross section extends in a direction parallel to said direction of sliding of said bins for allowing sliding removal of bins supported on said upper shelf and on said lower shelf and rotatable about said axis to a locking position wherein said longer dimension extends in a direction perpendicular to said direction of sliding of said bins for restraining removal of said bins supported on said upper shelf and said lower shelf; and means to selectively maintain said first locking bar in said locking position to selectively lock said bins within said side walls.

2. The cabinet in accordance with claim 1 wherein said means to selectively maintain said first locking bar comprises a second locking bar which is hingedly attached to one of said side walls.

3. The cabinet in accordance with claim 1 wherein said first locking bar has a geometric longitudinal centerline and wherein said axis of rotation is offset from said geometric longitudinal centerline to provide a gravitational force on said first locking bar urging rotation of said first locking bar to said locking position.

4. The cabinet in accordance with claim 1 wherein each of said bins comprises a front wall and a front drawing handle, said handle comprising a frontal piece spaced apart from and extending substantially parallel to said front wall and a pair of spaced-apart connecting side walls extending substantially perpendicular to said front wall and connecting said frontal piece to said front wall, said side walls each comprising an arcuate upper and lower section adjacent said front wall, said arcuate sections each having a radius of a dimension sufficient to allow rotation of said first locking bar about said axis of rotation.

5. The cabinet in accordance with claim 4 wherein said arcuate upper and lower sections have radii of differing dimensions.

6. A pharmaceutical cabinet comprising:

a pair of side walls in spaced-apart relationship;

a top wall and a bottom wall mounted to said side walls;

a pair of upper and lower spaced-apart substantially parallel shelves mounted between said side walls, each of said shelves having a front edge;

a plurality of dispensing bins supported on each of said shelves in a side-by-side relation and removable by sliding said bins in a direction substantially perpendicular to said front edge;

a first locking bar between said side walls and disposed frontally to a lower portion of each of said bins supported on said upper shelf and to an upper portion of each of said bins supported on said lower shelf and having an elongated cross section, said first locking bar rotatable about an axis of rotation extending in a direction substantially parallel to said front edges to a release position wherein a longer dimension of said elongated cross section extends in a direction parallel to said direction of sliding of said bins for allowing sliding removal of bins supported on said upper shelf and on said lower shelf and rotatable about said axis to a locking position wherein said longer dimension extends in a direction perpendicular to said direction of sliding of said bins for restraining removal of said bins supported on said upper shelf and said lower shelf; and a second locking bar hingedly attached to one of said side walls for selectively maintaining said first locking bar in said locking position to selectively lock said bins within said side walls;

said second locking bar having a locking pin to selectively engage at least one of said top and bottom walls and a lock operable for selectively disengaging said pin from engagement with said top and bottom wall.

7. The cabinet in accordance with claim 6 wherein said cabinet comprises wheels mounted beneath said bottom wall to facilitate movement of said cabinet in dispensing medicine.

8. A pharmaceutical cabinet comprising:

a pair of side walls in spaced-apart relationship;

at least one cassette mounted between said side walls, each cassette comprising a pair of upper and lower spaced-apart substantially parallel shelves, each of said shelves having a front edge;

a plurality of dispensing bins supported on each of said shelves in a side-by-side relation and removable by sliding said bins in a direction substantially perpendicular to said front edge;

a first locking bar mounted to said cassettes and disposed frontally to a lower portion of each of said bins supported on said upper shelf and an upper portion of each of said bins supported on said lower shelf and having an elongated cross section, said first locking bar rotatable about an axis of rotation extending in a direction substantially parallel to said front edges to a releasing position wherein a longer dimension of said elongated cross section extends in a direction parallel to said direction of sliding of said bins for allowing sliding removal of bins supported on said upper shelf and on said lower shelf and rotatable about said axis to a locking position wherein said longer dimension extends in a direction perpendicular to said direction of sliding of said bins for restraining removal of said bins supported on said upper shelf and said lower shelf; and a second locking bar hingedly attached to one of said side walls for selectively maintaining said first locking bars in said locking position to selectively lock said bins within said side walls;

said second locking bar operable to engage said first locking bars of each of said cassettes to maintain said first locking bars in said locking position.

9. The cabinet in accordance with claim 8 wherein said cassettes are horizontally disposed and slidably supported within said cabinet and wherein said second locking bar is pivotally attached to one of said walls and operable to engage said first locking bars and thereby obstructing sliding movement of said cassettes from said housing.

10. A pharmaceutical cabinet comprising:

a housing including side walls, a top wall and a bottom wall;

at least one cassette removably mounted in said housing and comprising a pair of side supports in spaced-apart relationship and at least one shelf mounted between and to said side supports, each of said shelves having a front edge;

at least one dispensing bin supported on one of said shelves and removably by sliding said bins in a direction substantially perpendicular to said front edge;

said cassette further comprising a first locking bar mounted to said side supports and disposed frontally to said at least one bin supported on said one shelf, said first locking bar being rotatable between a release position for allowing sliding removal of said bin supported on said one shelf and a locking position for blocking removal of said bin supported on said one shelf; and a second locking bar supported on said housing for selectively engaging said first locking bar to retain said first locking bar in said locking position and selectively engageable with said at least one cassette to block removal of said cassette from said housing.

11. The cabinet in accordance with claim 10 wherein said first locking bar is a passive locking bar freely movable between said release position and said locking position when not engaged by said second locking bar.

12. The pharmaceutical cabinet in accordance with claim 11 wherein said first locking bar is biased to said locking position.

13. The cabinet in accordance with claim 10 wherein said at least one cassette has upper and lower spaced-apart substantially parallel shelves mounted to and between said side supports, at least one of said bins are mounted on each of said upper and lower shelves, and said first locking bar is disposed frontally to only a lower portion of said bin on said upper shelf and to only an upper portion of said bin on said lower shelf when said locking bar is in said locking position.

14. The pharmaceutical cabinet in accordance with claim 10 and further comprising at least one drawer removably supported in said cabinet and wherein said second locking bar is selectively movable to a position for engaging said first locking bar, said at least one cassette, and said at least one drawer to retain said first locking bar in said locked position and block removal of said cassette and said drawer from said cabinet.

15. A pharmaceutical cabinet comprising:

a housing having a pair of side supports in spaced-apart relationship;

upper and lower spaced-apart substantially parallel shelves mounted to and between said side supports and each having a front edge;

a plurality of dispensing bins, at least one of said bins disposed on each of said shelves and removable by sliding said bins in a direction substantially perpendicular to said front edge; and a bin locking bar mounted to and between said side supports, said locking bar rotatable to a release position wherein said locking bar is positioned in a plane extending between bins on said upper shelf and bins on said lower shelf for allowing sliding removal of said bins and to a locking position for blocking removal of said bins, said locking bar disposed frontally to a lower portion of bins on said upper shelf and to an upper portion of bins on said lower shelf when said locking bar is in said locking position, said locking bar further being shaped to permit removal of bins from said upper and lower shelves when said locking bar is in said release position and further being shaped to block removal of bins from said upper and lower shelves when said locking bar is in said locking position.

16. The cabinet in accordance with claim 15 wherein said locking bar is disposed frontally to and in register with said upper shelf.

17. The cabinet in accordance with claim 16 wherein said locking bar is disposed frontally to only a lower portion of bins on said upper shelf and only an upper portion of bins on said lower shelf when said locking bar is in said locking position.

* * * * *